US010595697B2

(12) United States Patent
Runnoe et al.

(10) Patent No.: US 10,595,697 B2
(45) Date of Patent: Mar. 24, 2020

(54) SURFACE MAINTENANCE MACHINE WITH SKIRTING TO ALLOW PARTICULATE PICKUP

(71) Applicant: Tennant Company, Minneapolis, MN (US)

(72) Inventors: Adam J. C. Runnoe, Minneapolis, MN (US); Laurence A. Jensen, Oakdale, MN (US); Erik M. Weatherly, Minnetonka, MN (US); Derek R. Younggren, Spring Lake Park, MN (US)

(73) Assignee: Tennant Company, Minneapolis, MN (US)

( * ) Notice: Subject to any disclaimer, the term of this patent is extended or adjusted under 35 U.S.C. 154(b) by 196 days.

(21) Appl. No.: 15/421,877

(22) Filed: Feb. 1, 2017

(65) Prior Publication Data

US 2017/0215683 A1 Aug. 3, 2017

Related U.S. Application Data

(60) Provisional application No. 62/290,011, filed on Feb. 2, 2016.

(51) Int. Cl.

| | |
|---|---|
| ***A47L 11/24*** | (2006.01) |
| ***A47L 11/40*** | (2006.01) |
| ***A47L 11/30*** | (2006.01) |

(52) U.S. Cl.

CPC ..... *A47L 11/4077* (2013.01); *A47L 11/24* (2013.01); *A47L 11/302* (2013.01); (Continued)

(58) Field of Classification Search

CPC .... A47L 11/4077; A47L 11/24; A47L 11/302; A47L 11/4013; A47L 11/4038; (Continued)

(56) References Cited

U.S. PATENT DOCUMENTS

| | | | |
|---|---|---|---|
| 1,149,271 | A | 8/1915 | Lazarus |
| 3,892,008 | A | 7/1975 | Christensen et al. |

(Continued)

FOREIGN PATENT DOCUMENTS

| | | | |
|---|---|---|---|
| DE | 2845212 | A1 | 10/1979 |
| EP | 982437 | A1 | 10/2004 |

(Continued)

OTHER PUBLICATIONS

International Patent Application No. PCT/US2017/015986, International Search Report and Written Opinion dated Jul. 5, 2017, 22 pages.

(Continued)

*Primary Examiner* — Robert J Scruggs

(74) *Attorney, Agent, or Firm* — Fredrikson & Byron P.A.

(57) ABSTRACT

Embodiments include a surface maintenance machine, comprising a maintenance tool chamber comprising a first side, a second side, a third side and a fourth side. A rotary broom is housed in the maintenance tool chamber and substantially enclosed by the first, second, third and fourth sides thereof. The rotary broom sweeps particulate from the surface. A vacuum system generates vacuum for drawing particulate swept by the rotary broom. The vacuum system is positioned proximal to the first side. A skirt assembly extends substantially around the second, third and fourth sides of the maintenance tool chamber. The skirt assembly has a vacuum passage defined therein and in fluid communication with the vacuum system to direct air flow into the vacuum passage, thereby drawing particulate into the vacuum passage and preventing particulate accumulation at portions of the second, third and fourth sides that are distal to the vacuum system.

12 Claims, 8 Drawing Sheets

(52) U.S. Cl.
CPC ..... *A47L 11/4013* (2013.01); *A47L 11/4038* (2013.01); *A47L 11/4041* (2013.01); *A47L 11/4044* (2013.01); *A47L 11/4055* (2013.01)

(58) Field of Classification Search
CPC ..... A47L 11/4041; A47L 11/4044; A47L 11/4055; A47L 11/34; A47L 11/4088; A47L 11/4083; A47L 11/30
See application file for complete search history.

(56) References Cited

U.S. PATENT DOCUMENTS

| | | | | |
|---|---|---|---|---|
| 4,000,538 | A | 1/1977 | Tissier | |
| 4,805,256 | A | 2/1989 | Mason et al. | |
| 4,819,676 | A * | 4/1989 | Blehert | A47L 11/24 134/21 |
| 5,659,921 | A | 8/1997 | Narayan | |
| 6,018,844 | A | 2/2000 | Basham et al. | |
| 6,742,219 | B2 | 6/2004 | Lenzmeier et al. | |
| 8,099,828 | B2 * | 1/2012 | Adelman | A47L 11/4013 15/340.1 |
| 8,584,294 | B2 | 11/2013 | Loring | |
| 10,092,152 | B2 | 10/2018 | Scott et al. | |
| 2002/0194692 | A1 * | 12/2002 | Giddings | A47L 11/292 15/320 |
| 2008/0276407 | A1 | 11/2008 | Schnittman et al. | |
| 2009/0064452 | A1 * | 3/2009 | Thatcher | A47L 11/10 15/364 |
| 2012/0096671 | A1 | 4/2012 | Venard et al. | |
| 2013/0189908 | A1 * | 7/2013 | Strickland | A47L 11/16 451/259 |

FOREIGN PATENT DOCUMENTS

| | | | |
|---|---|---|---|
| EP | 1690984 | A2 | 8/2006 |
| EP | 2532788 | A2 | 12/2012 |
| WO | 2006121783 | A1 | 11/2006 |

OTHER PUBLICATIONS

Invitation to Pay Fees with Partial International Search for International Application No. PCT/US2017/015986, dated May 10, 2017, 16 pages.

* cited by examiner

SURFACE MAINTENANCE MACHINE WITH SKIRTING TO ALLOW PARTICULATE PICKUP

RELATED APPLICATION

This application claims the benefit of U.S. Provisional Patent Application No. 62/290,011 filed Feb. 2, 2016, the entire contents of which is hereby incorporated by reference.

BACKGROUND

Surface maintenance machines include vehicles and devices that can be self-powered, towed, or pushed, and/or manually powered. Surface maintenance machines commonly include a cleaning head having one or more maintenance tools (e.g., a rotating drum brush) operated by one or more motors. Each maintenance tool is configured to perform a desired treating operation on the surface. For example, in cases where the surface maintenance machine is a surface maintenance machine, one or more brushes sweep dirt and debris from a surface and throw loose debris into a hopper. The brush may be housed in a maintenance tool chamber in such cases.

Typically during the operation of a sweeper, sweeping tools that move and direct debris and generate particulate may cause adverse air currents that can be hard to control. In such cases, a vacuum system directing airflow in a predetermined direction can be commonly used to control the particulate and adverse air currents that are generated during the sweeping process. The surface maintenance machine may also include skirt assemblies comprising a single row of skirts on the front, lateral sides and/or rear of the machine, under which vacuum may be generated by the vacuum system thereby drawing particulate toward the hopper. As a result of the presence of the front skirt, large debris may not get drawn inward toward the machine during the sweeping process, and may be thrown off (sometimes referred to as "plowing.")

SUMMARY

In one example, the present disclosure includes a surface maintenance machine, comprising a body, comprising a transverse centerline. The surface maintenance machine can include a pair of brooms comprising a front broom and a rear broom. The pair of brooms can be positioned generally to the front of the transverse centerline when the machine is moving in a generally forward direction. The pair of brooms can rotate in a direction opposite to each other, whereby the counter-rotation of the pair of brooms can sweep the surface, including sweeping particulate located on the floor. The surface maintenance machine can include a vacuum system adapted to generate vacuum for drawing the particulate swept by the pair of brooms. An inlet of the vacuum system can be positioned generally to the front of the transverse centerline. The surface maintenance machine can include a chute positioned above the pair of counter-rotating brooms that can be fluidly coupled to the vacuum system. The pair of brooms can be exposed on the front to a portion of the surface such that each of the pair of brooms rotates in opposite directions to direct particulate present on the portion of the surface in front of the pair of brooms toward the chute.

In another example, the pair of brooms housed in a sweep chamber can draw particulate on the surface to the front of the pair of brooms inwardly toward the surface maintenance machine. In such examples, the surface maintenance machine can include a skirt assembly generally surrounding the pair of brooms forms a vacuum passage to fluidly isolate the sweep chamber from an exterior of the surface maintenance machine. The skirt assembly can include side skirts and a rear skirt. The rear skirt can be positioned to the rear of the pair of brooms when the machine is moving in a generally forward direction. The skirt assembly may not surround the pair of brooms on the front of the pair of brooms so that particulate on the surface to the front of the pair of brooms is drawn toward the surface maintenance machine due to air currents generated during the rotation of the pair of brooms.

In another example, each of the pair of brooms can rotate in a direction opposite to each other, such the rotation of a first broom can draw particulate inwardly toward the surface maintenance machine, and the rotation of the a second broom can lift particulate toward a hopper housed thereabove.

BRIEF DESCRIPTION OF DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
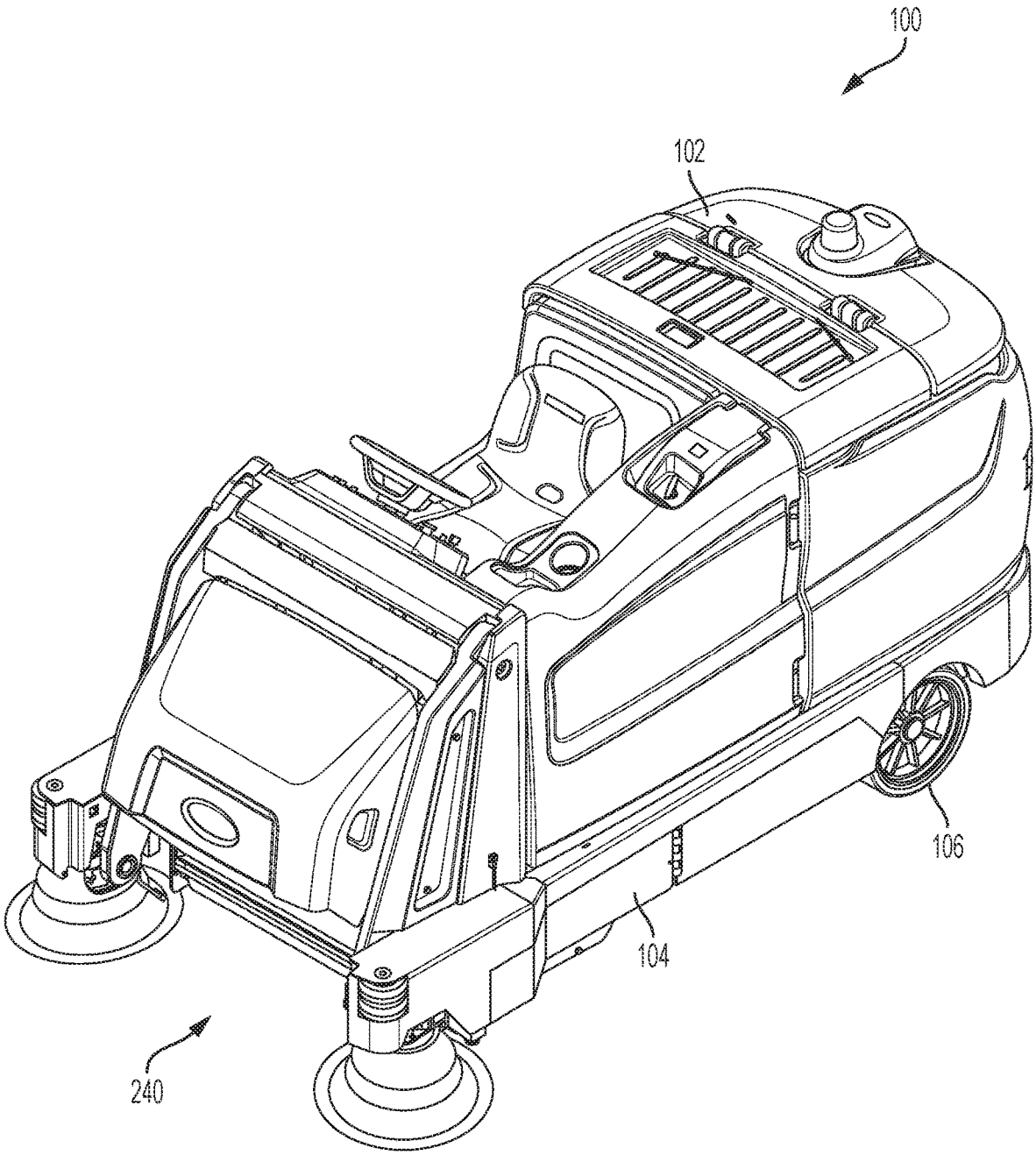
FIG. 1 is a perspective view of a surface maintenance machine according to an embodiment.

FIG. 1 is a perspective view of an exemplary surface maintenance machine 100. In the illustrated embodiment shown in FIG. 1, the surface maintenance machine 100 is a ride-on machine 100 used to treat hard surfaces. In other embodiments, the surface maintenance machine 100 can be a walk-behind machine 100 or a towed-behind machine 100, such as the surface maintenance machine 100 described in U.S. Pat. No. 8,584,294 assigned to Tennant Company of Minneapolis, Minn., the disclosure of each of which is hereby incorporated by reference in its entirety. The surface maintenance machine 100 can perform maintenance tasks such as sweeping (e.g., removing dust, debris or other particulate from the surface 152). As referred to herein, particulate may refer to dust as well as large and loose debris). In some cases, the machine 100 is a mechanical sweeper configured for mechanically moving particulate from the surface 152. Alternatively, the machine 100 can be a combination sweeper-scrubber, or a burnisher. Other operations such as scrubbing, polishing (burnishing) a surface 152 are also contemplated. The surface 152 can be a surface 152, pavement, road surface 152 and the like.

Embodiments of the surface maintenance machine 100 include components that are supported on a mobile body 102. As best seen in FIG. 1, the mobile body 102 comprises a frame 104 supported on wheels 106 for travel over a surface 152, on which a surface 152 maintenance operation is to be performed. The mobile body 102 may include operator controls (not shown) and a steering control such as a steering wheel 108. The surface maintenance machine 100 can be powered by an on-board power source such as one or more batteries, a fuel-cell, or an internal combustion engine (not shown). The power source can be proximate the front of the surface maintenance machine 100, or it may instead be located elsewhere, such as within the interior of the surface maintenance machine 100, supported within the frame 104, and/or proximate the rear of the surface maintenance machine 100. Alternatively, the surface maintenance machine 100 can be powered by an external electrical source (e.g., a power generator) via an electrical outlet. The interior of the surface maintenance machine 100 can include electrical connections (not shown) for transmission and control of various components.

The machine 100 can include a maintenance tool for performing one or more cleaning tasks. For instance, the maintenance tool can perform sweeping, scrubbing, polishing/burnishing, striping, dry and wet vacuuming, and the like. Many different types of maintenance tools are used to perform such cleaning operations on the surface 152. These include sweeping, scrubbing brushes, polishing/burnishing and/or buffing pads. In the embodiments illustrated herein, the machine 100 is a surface maintenance machine 100 wherein the maintenance tool can be a pair of rotary brooms 110, 112. Alternatively, the machine 100 can be a combination sweeper-scrubber in which case the machine 100 can include one or more scrub-brushes in addition to the brooms 110, 112, or a burnisher in which case the machine 100 can include one or more burnishing/polishing pads. The brooms 110, 112 can extend from the underside of the machine 100 and can be supported by an elongated cleaning head (not shown). While not illustrated, the cleaning head can house other maintenance tools (e.g., side brooms, scrubbing brush, and burnishing/polishing pads). The cleaning head assembly can be attached to the body 102 of the machine 100 such that the cleaning head can be lowered to a operating position and raised to a transport position. The cleaning head assembly is connected to the machine 100 using any known mechanism, such as a suspension and lift mechanism such as those illustrated in U.S. Pat. No. 8,584,294 assigned to Tennant Company of Minneapolis, Minn., the disclosure of each of which is hereby incorporated by reference in its entirety. The rotary brooms 110, 112 can be releasably loaded to or unloaded from the surface maintenance machine 100.

Figure 2:
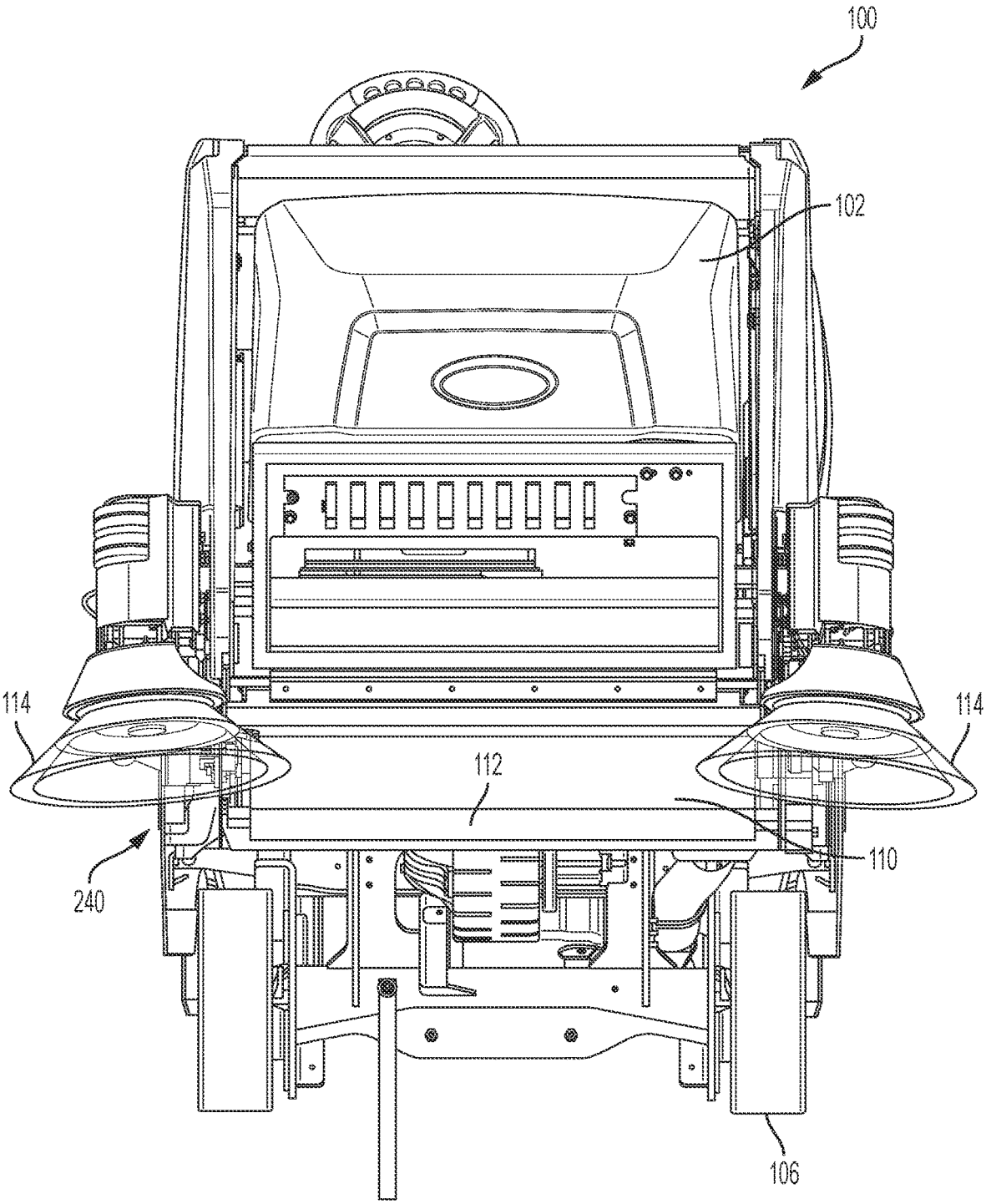
FIG. 2 is a front perspective view of the surface maintenance machine shown in FIG. 1.

While a pair of counter-rotating brooms 110, 112 is shown in FIG. 2, other maintenance tools can also be provided. In cases where the machine 100 is a combination sweeper-scrubber, or a burnisher, the maintenance tool chamber can hold other maintenance tools (e.g., a scrub brush, a burnishing pad and the like) raised and lowered by a cleaning head (not shown). Additionally, the machine 100 may also have side brushes 114 positioned laterally on the machine 100 to maintain a larger envelope of the surface 152.

Referring to FIG. 2, the rotary brooms 110, 112 extend from a bottom surface 152 of the body 102 of the machine 100 and are rotatable. The brooms 110, 112 can be driven by a driver (e.g., a motor, not shown). The rotation of the rotary brooms 110, 112 generates air currents within a sweep chamber 115. As the brooms 110, 112 rotate, particulate are picked up (e.g., swept) from the floor and acted upon by a vacuum system 150 as will be described below. The brooms 110, 112 are counter-rotating, and rotate in opposite directions such that the air currents generated by one broom are countered by those generated by the other broom. Such embodiments can be beneficial for ideally directing all the particulate into a hopper 144. In sweeping systems known in the art, air currents due to broom rotation can have an associated positive pressure therewith such that particulate may sometimes be thrown off towards the outside of the machine 100. However, the counter-rotating brooms 110, 112 reduce such throwing off of particulate, whereby air currents due to one broom are countered by air currents due to the other broom to draw and pick up particulate. In addition to counteracting the air currents due to rotation of the rear broom 112, the front broom 110 may perform other functions typically performed by a front skirt, thereby eliminating the need for a front skirt. For example, the front broom 110 may fluidly isolate the vacuum generated by the vacuum system 150 from the exterior of the machine, and thereby facilitate maintaining and containing the vacuum over a desired area (e.g., the sweep chamber 115) and to direct particulate toward the hopper 144.

With continued reference to FIG. 2, as mentioned previously, the maintenance tools include a pair of brooms 110, 112 positioned generally to the front of the transverse centerline 120 when the machine 100 is moving in a generally forward direct. The front broom 110 can be a leading broom and the rear broom 112 can be a trailing broom when the machine is moving in a generally forward direction 153, and the rear broom 112 can be the leading broom and the front broom 110 can be the trailing broom when the machine is moving in a generally rearward direction (opposite to the forward direction 153). As referred to herein, the terms "front", "sides", "rear", "upwards", "downward", "inward", "outward" "rearward" and "forward" take their ordinary meaning as is apparent to one skilled in the art. The brooms 110, 112 are movable between a transport position (illustrated in FIGS. 1-4) and an operating position (illustrated in FIGS. 5-7). In the transport position, the brooms 110, 112 are lifted above the surface 152 (e.g., relative to the vertical position of the wheels 106 of the machine 100) such that they do not contact the surface 152 on which the machine 100 is being operated. Conversely, in the operating position, the brooms 110, 112 are lowered toward the surface 152 and are generally in contact with the surface 152. In some cases, the machine 100 may travel on uneven surfaces. In such cases, the brooms 110, 112 may or may not be in contact with the surface 152. Optionally, such embodiments may include a suspension mechanism (not shown) to maintain the brooms 110, 112 generally in contact with the surface 152 when passing over undulations thereon.

Figure 3:
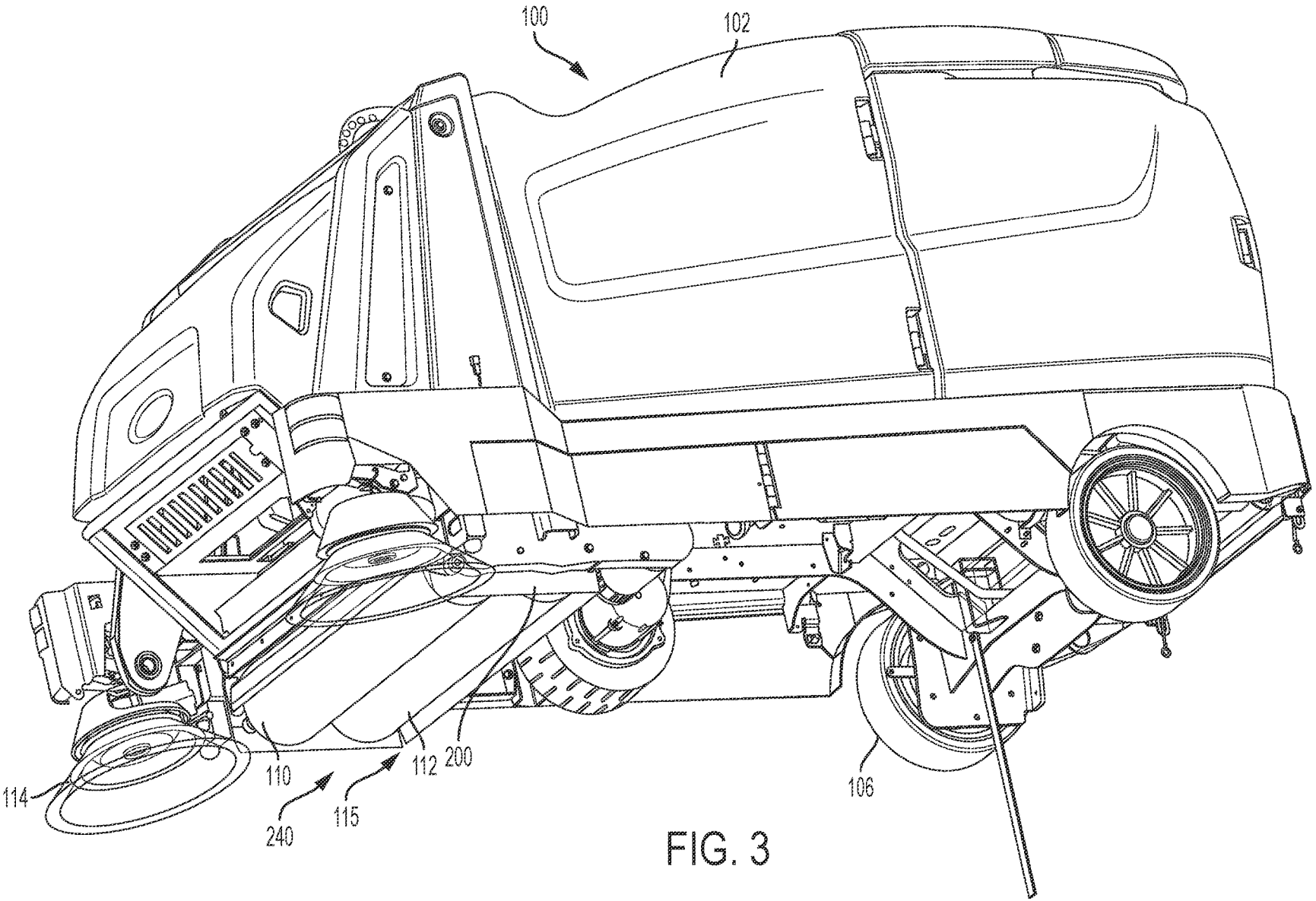
FIG. 3 is a side perspective view of the surface maintenance machine shown in FIG. 1.

Referring now to FIGS. 2 and 3, the brooms 110, 112 comprise a front broom 110 and a rear broom 112 that are rotatable in a direction opposite to each other. As will be described further below, the brooms 110, 112 are generally exposed on the front 120 to a portion of the surface 152 when the machine 100 is moving in a generally forward direction 153. Advantageously, the front broom 110 performs functions such as containing vacuum within the sweep chamber 115. In such cases, advantageously, the brooms rotate in opposite directions 122, 124 to direct particulate present on the portion of the surface 152 in front of the pair of brooms 110, 112 toward a particulate collection system 140 (best seen in FIGS. 4-6B). In such cases, each broom can be powered independently by a motive source (e.g., a motor) adapted to rotate each broom in preferred direction such that the brooms 110, 112 may rotate generally opposite to each other. Moreover, the speed of rotation of each broom can be independently controlled by the motive source of the respective brooms.

Figure 4:
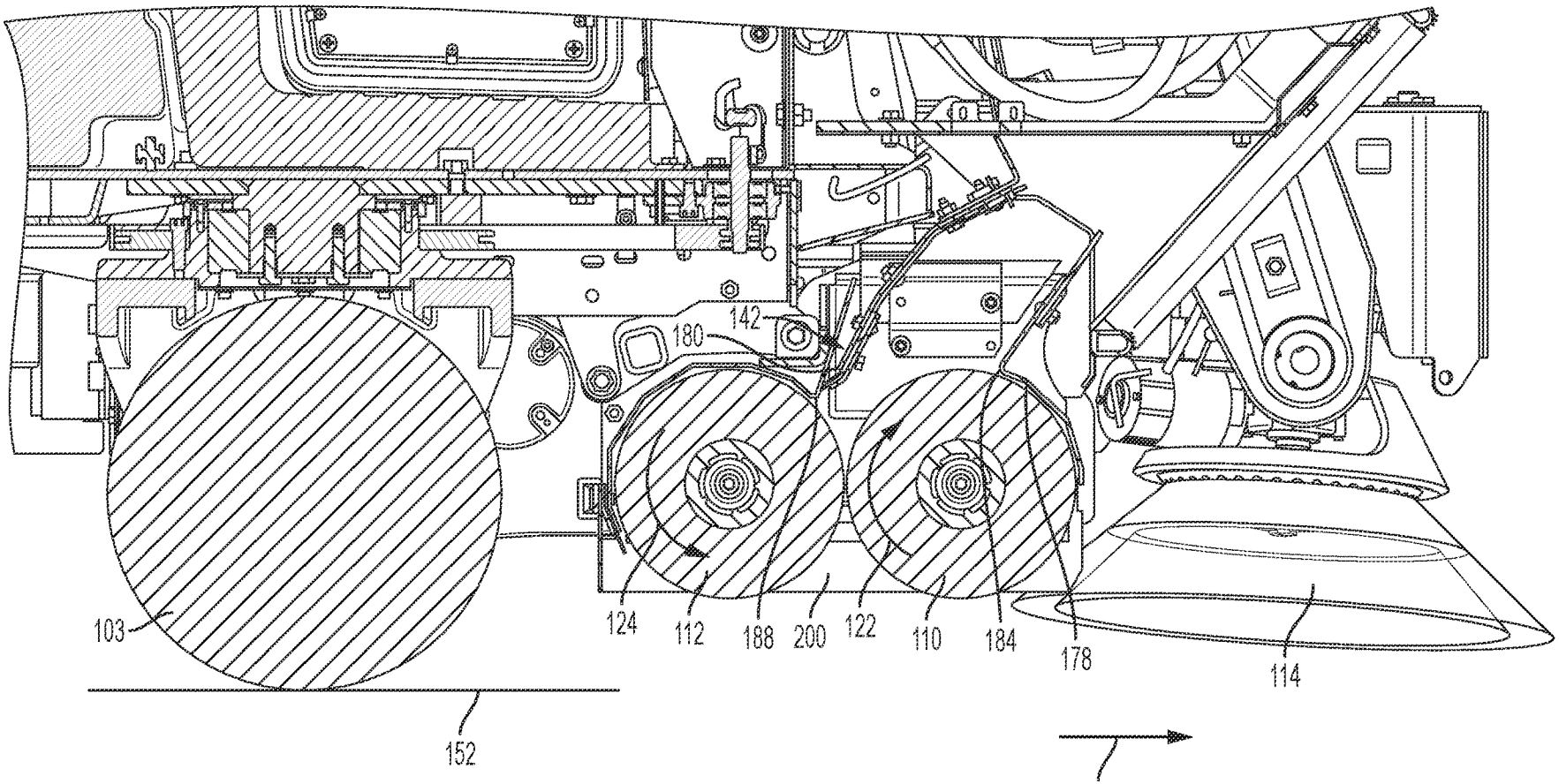
FIG. 4 is a cross-sectional side view of the surface maintenance machine shown in FIG. 1 with the brooms in the transport position.

Referring now to FIG. 4, the front broom 110 rotates in a direction 122 toward the transverse centerline 120, and the rear broom 112 rotates in a direction 124 away from the transverse centerline 120. For instance, in the embodiments contemplated herein, the front broom 110 rotates in generally the same direction as the rotation of the wheels 106, such that the brooms sweep particulate generally in the same direction as the direction of travel of the machine. More generally, the rotation of the leading broom can be generally in the same direction as the rotation of the wheel 106 and the rotation of the trailing broom can be opposite to the rotation of the leading broom. For instance, referring to FIG. 4, if the machine moves along the forward direction 106, the wheels move in a generally clockwise direction. The leading broom in such a case is the front broom 110, and it can rotate in the same direction (clockwise) as the rotation of the wheels 106.

As is apparent to one skilled in the art, brooms 110, 112 generate air currents in a direction generally tangential to their rotation. Advantageously, in certain embodiments disclosed herein, such air currents facilitate collection of particulate from the surface 152 and direct them into a particulate collection system 140. For instance, referring to FIG. 5, each of the pair of brooms 110, 112 generates air currents associated with their rotation generally tangentially to the direction of their rotation. For example, the air currents of the front broom 110 near a front portion of the front broom 110 can be directed downward and inward (e.g., as shown by arrow 126) toward the machine 100. Similarly, the air currents generated due to the rotation of the rear broom 112 is in a direction that counters the effects of the air currents generated by the front broom 110 to facilitate lifting of the particulate toward the particulate collection system 140. For instance, the air currents generated near a front portion of the rear broom 112 can be directed upward (e.g., as shown by arrow 128). Thus, the air currents generated by the pair of brooms 110, 112 cooperatively collect particulate from the front of the machine 100 and direct it toward the particulate collection system 140.

With continued reference to FIG. 4, the front and rear brooms 110, 112 can be spaced such that they facilitate optimal particulate collection. For instance, in the illustrated embodiment, the front and rear brooms 110, 112 have a gap 130 therebetween. The gap 130 can be configured to a suitable value to facilitate effective collection of particulate. For example, the gap 130 between the front and rear brooms 110, 112 can be between about 0.125 inches. Other distances are also contemplated, and the values provided herein should not be construed as limiting. Alternatively, the brooms 110, 112 can be arranged such that the tips of the bristles of the front and rear brooms 110, 112 contact each other.

Figure 5:
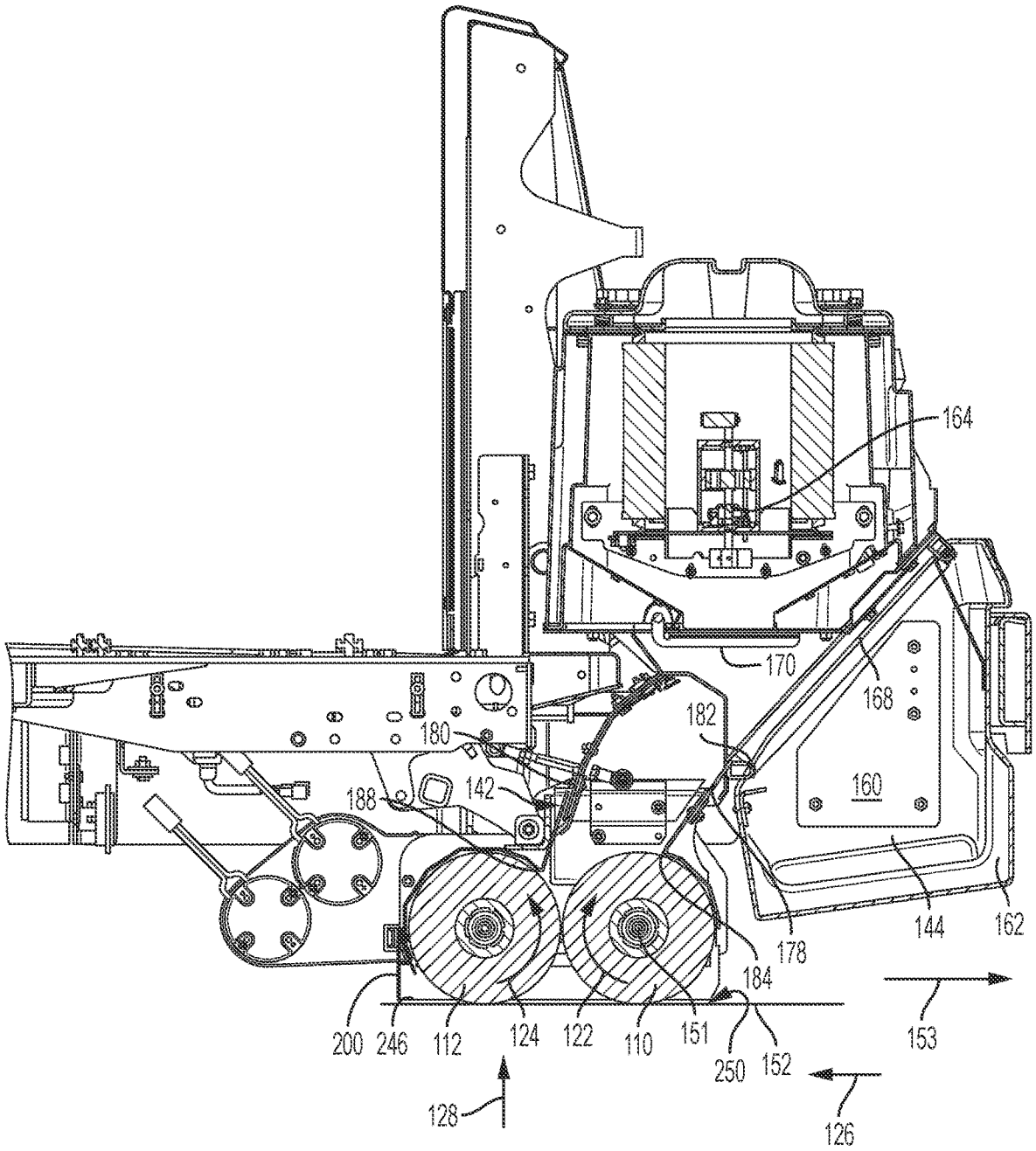
FIG. 5 is a cross-sectional side view of the surface maintenance machine shown in FIG. 1 with the brooms in the operating position.

Referring now to FIG. 5, the machine 100 can include a particulate collection system 140. The particulate collection system 140 can comprise a chute 142, a hopper 144 (best shown in FIG. 5) and a vacuum system 150 (best shown in FIGS. 6A and 6B). In the illustrated embodiment, the hopper 144 is positioned generally to the front of and above a rotational axis 151 (shown by a point) of the pair of brooms 110, 112 when the machine 100 is moving in a generally forward direction 153. For instance, the hopper 144 is positioned to the front of the front broom 110, with at least one wall 154 of the hopper 144 contacting the chute 142. In the illustrated embodiment, as described previously, the rotation of the pair of brooms 110, 112 facilitates pick up of particulate from the surface 152 and direct it toward the hopper 144. Alternatively, the hopper 144 can be positioned toward the back of the machine 100, when the machine 100 is moving in a generally forward direction 153. The hopper 144 shown in FIG. 6A comprises a plenum 160 and associated plenum panels 162. The plenum 160 can be coupled to and/or support one or more components of the vacuum system 150 shown in FIG. 6A.

Figure 6B:
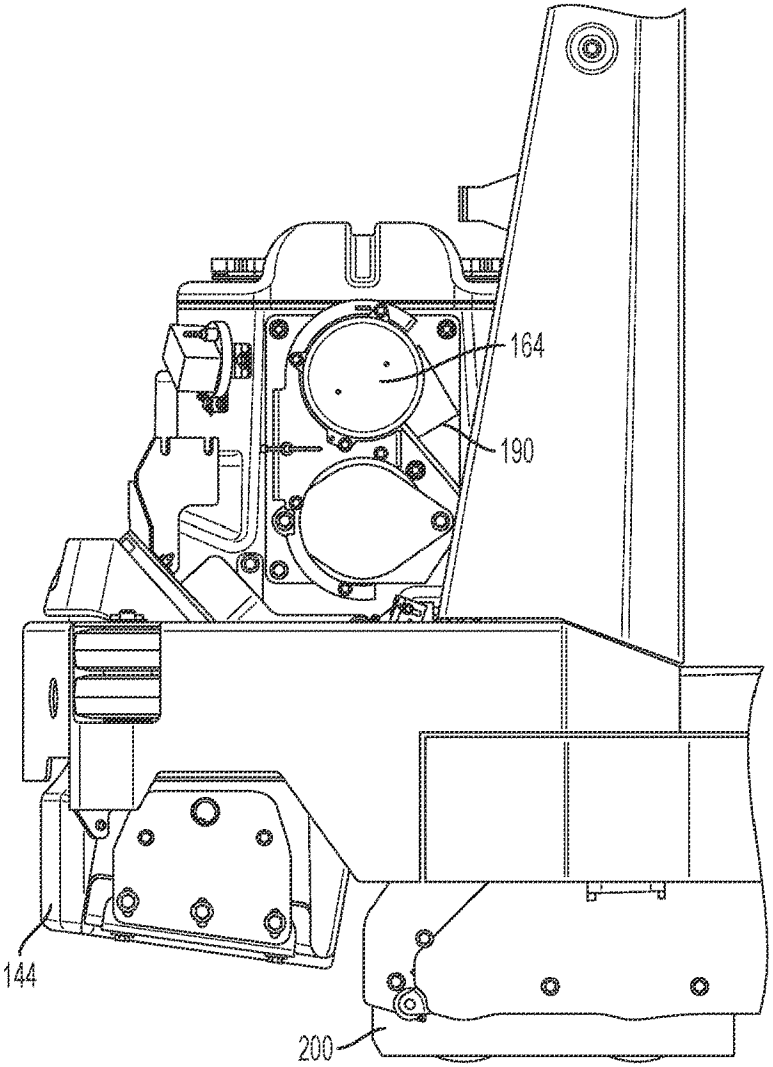
FIG. 6B is a right side view illustrating portions of the particulate collection system shown in FIG. 6A.
Figure 6A:
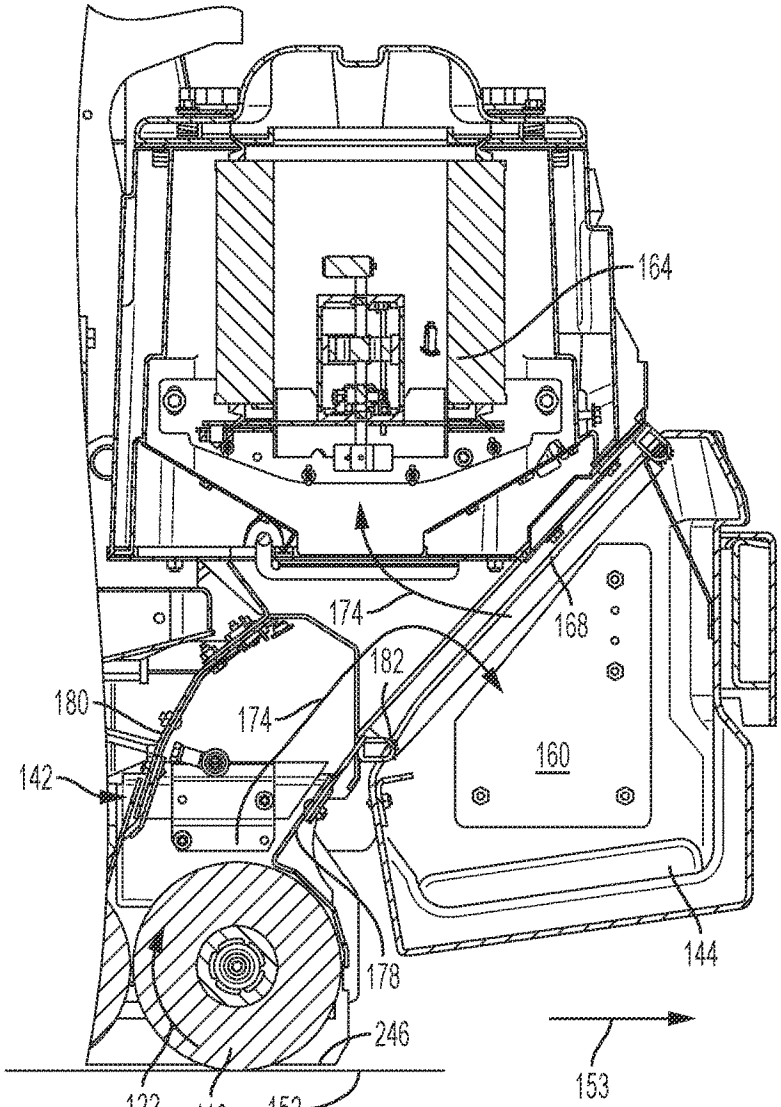
FIG. 6A is a left side view illustrating portions of a particulate collection system according to an embodiment.

The particulate collection system 140 comprises a vacuum system 150 best illustrated in FIGS. 6A and 6B. The vacuum system 150 can comprise a vacuum source 164, such as a fan housed in a fan housing 166. In some cases, the vacuum system 150 can include a filtration system (hidden, housed on the wall 168) including a filter and other components which provide for support and function thereof. One example of a filtration system is described in the commonly-assigned U.S. Pat. No. 8,099,828, the disclosure of which is hereby incorporated by reference. The vacuum system 150 generates vacuum for drawing particulate swept by the pair of brooms 110, 112. In some such examples, an inlet 170 of the vacuum system 150 can be positioned generally to the front of the transverse centerline 120 (e.g., in front of and above the chute 142). Such cases facilitate an air flow as illustrated by arrows 174 in FIG. 6A, whereby particulate is drawn toward and settled in the hopper 144 and the air flow passes through the filtration system and leaves through the exhaust port 190 shown in FIG. 6B.

Referring back to FIG. 6A, the particulate collection system 140 comprises a chute 142 positioned above the pair of counter-rotating brooms 110, 112. As described above, the chute 142 is fluidly coupled to the vacuum system 150, such that air flow drawn by the vacuum fan passes from between the brooms 110, 112 and into the chute 142, facilitating particulate pick-up. Particulate and air flow leaving the chute 142 enters the hopper 144, wherein the particulate settles in the hopper 144. As seen in FIG. 6A, the chute 142 is defined by a front wrap 178 and a rear wrap 180. The front wrap 178 abuts against a lip 182 of a rear plenum 160 panel of the hopper 144. Each of the front wrap 178 and rear wrap 180 contacts a broom. For example, the front wrap 178 contacts the front broom 110 and the rear wrap 180 contacts the rear broom 112. The point of contact in some cases can be referred to as a "pick-off point" 184, 188. In the operating position illustrated in FIG. 6A, the pick-off points can be arranged such that the front and rear wraps form a passage for particulate to be directed from between the pair of brooms 110, 112 and into the hopper 144. Thus, the rear wrap 180 of the chute 142 is positioned further forward in the transport position relative to its position in the operating position (seen in FIG. 4). For example, as seen in the close-up view of FIG. 7, the pick-off points can be approximately at the one o'clock position on the brooms 110, 112, thereby forming a passage to direct particulate into the hopper 144. However, other locations of the pick-off points on the broom to facilitate optimal collection of particulate are also contemplated. Conversely in the transport position seen in FIG. 4, the point of contact of the rear wrap 180 on the rear broom 112 is approximately at the two o'clock position and is further forward of the pick-off point at the operating position illustrated in FIGS. 5 and 7. Such embodiments facilitate the front and rear wraps of the chute 142 to be configured to allow optimal collection of particulate.

Figure 7:
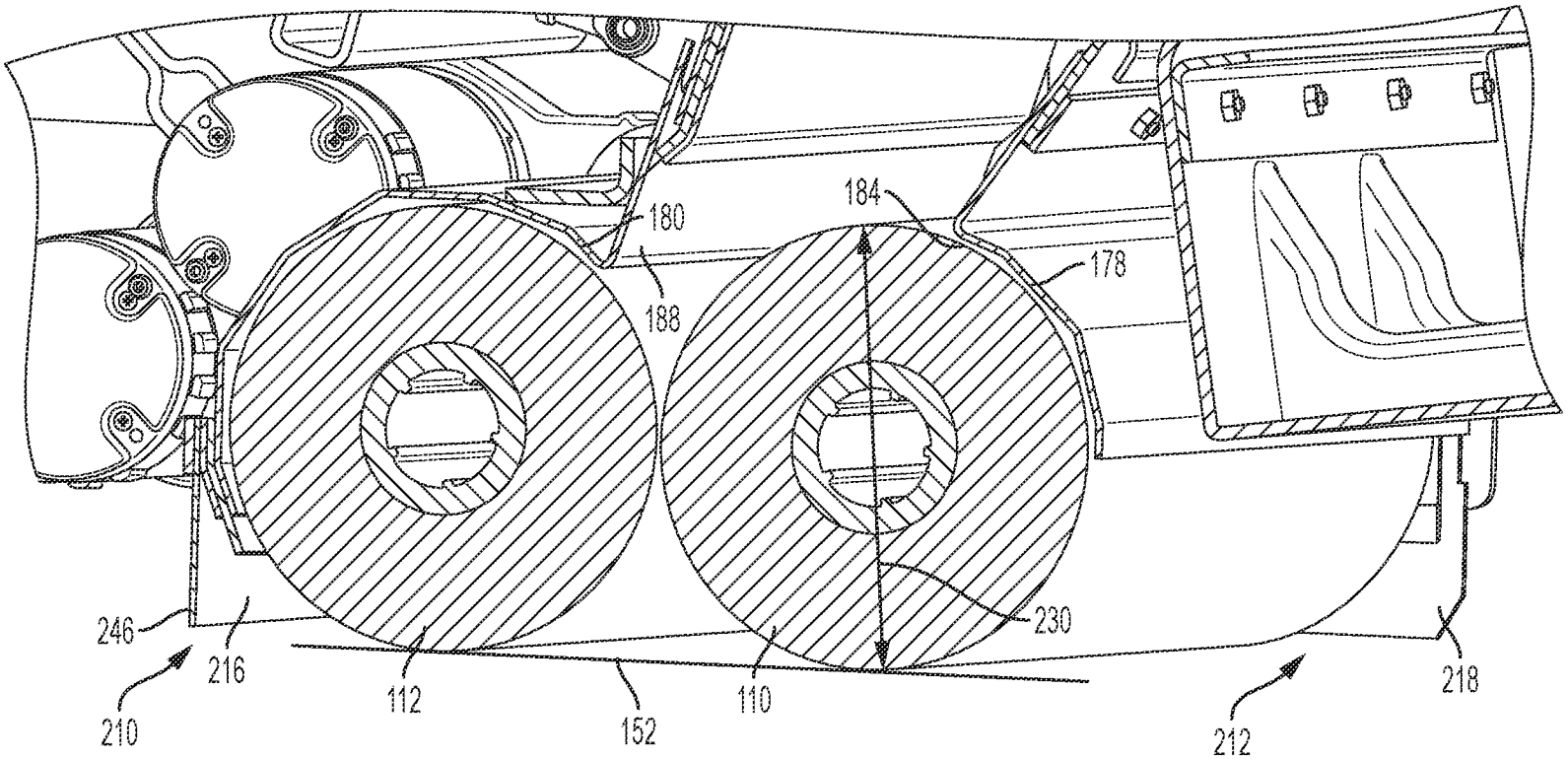
FIG. 7 is a close-up view of a portion of a skirt assembly according to an embodiment.
Figure 8:
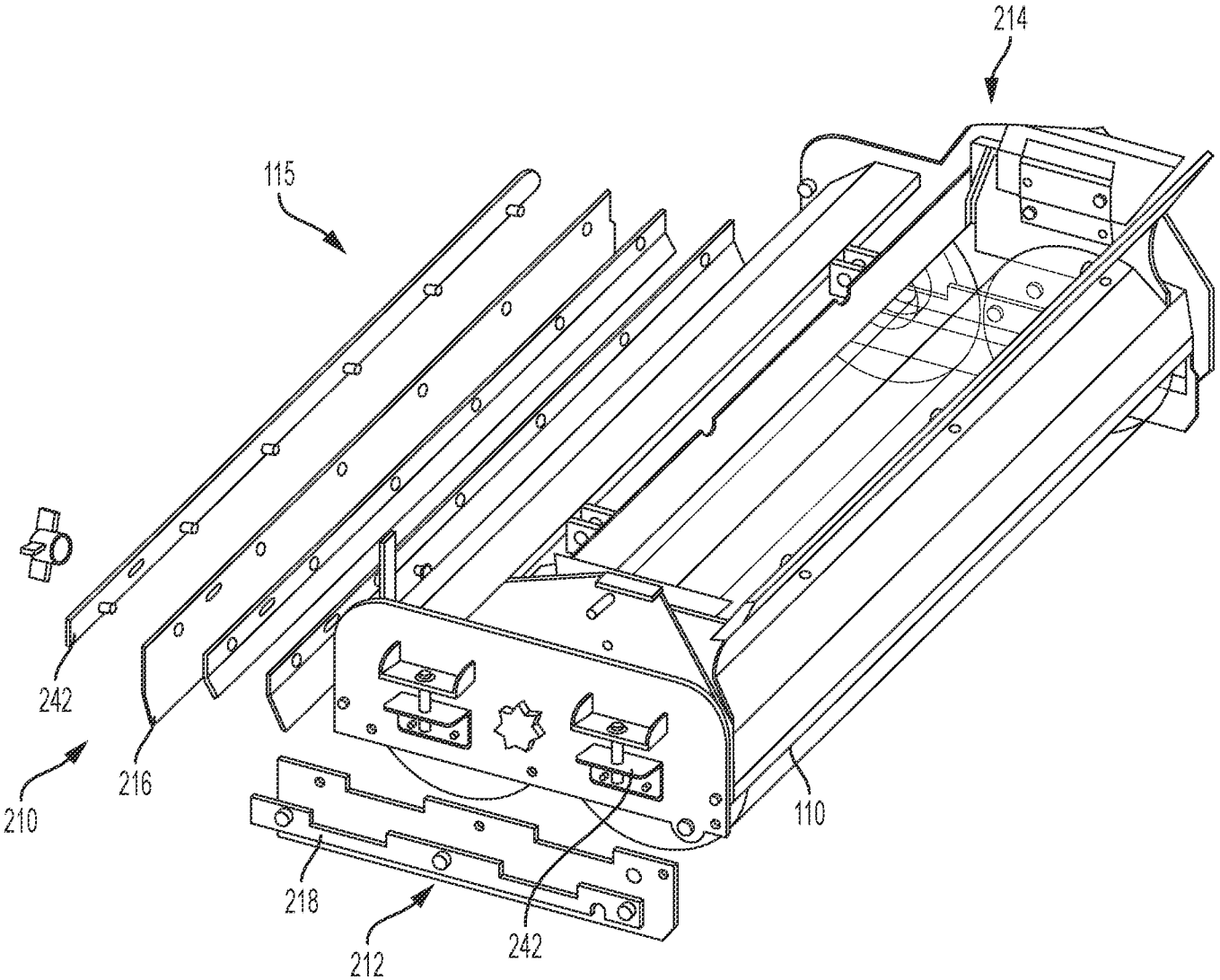
FIG. 8 is an exploded perspective view of the skirt assembly shown in FIG. 7.

Referring now to FIGS. 7 and 8, the surface maintenance machine 100 comprises a skirt assembly 200. The skirt assembly 200 can be a separate component, or be integral with the frame 104 of the machine 100. The skirt assembly 200 comprises a rear skirt 216 and side skirts 218 that generally surround the pair of brooms 110, 112. As best seen in FIG. 8, the brooms 110, 112 are enclosed in a sweep chamber 115. The skirt assembly 200 generally surrounds the brooms 110, 112 on the rear 210 and the sides 212, 214 to form a vacuum passage to fluidly isolate the rear 210 and sides 212, 214 of the sweep chamber 115 from an exterior of the surface maintenance machine 100. As seem in FIGS. 7 and 8, the rear skirt 216 is positioned to the rear of the pair of brooms 110, 112 when the machine 100 is moving in a generally forward direction 153. The rear skirt 216 is positioned farther away from and opposite to the inlet 170 of the vacuum system 150. The skirt assembly 200 according to some such embodiments does not surround the pair of brooms 110, 112 on the front so as to facilitate particulate on the surface 152 to the front of the pair of brooms 110, 112 being drawn toward the surface maintenance machine 100 due to air currents generated during the rotation of the pair of brooms 110, 112.

The skirt assembly 200 does not surround the front of the front broom 110, such that the front broom 110 is substantially unobstructed in the forward direction 153 by any portion of the surface maintenance machine 100. For instance, at least a bottom half of the front broom 110 is unobstructed in the forward direction 153 by any portion of the surface maintenance machine 100. Referring to FIG. 7, for instance, it can be seen that the front broom 110 extends a broom height 230 above the surface 152 when operating on the surface 152. In such cases, the skirt assembly 200 seals the sides 212, 214 and the rear 210 of the sweep chamber 115, while having the front of the front broom 110 exposed such that at least one-half of the front broom 110 is unobstructed in the forward direction 153 by any portion of the surface maintenance machine 100. As used herein, the term "unobstructed" refers to being unobstructed to drawing particulate.

The skirts can be mounted from components of the frame 104 of the machine 100 from a bottom portion 240 of the machine 100. For instance, as shown in FIG. 8, the skirts can be mounted on a retainer bracket by fasteners 242. In some cases best seen in FIGS. 7 and 8, the skirts are positioned such that they seal the rear 210 and sides 212, 214 of the sweep chamber 115. In such cases, an edge 246 of each skirt can be spaced no greater than a predetermined ground clearance 250 from the surface 152 on which the surface maintenance machine 100 is positioned. Such embodiments facilitate the skirts to seal the sides 212, 214 and the rear 210 of the sweep chamber 115 and prevent dusting from happening on those portions. In some cases, the maximum permissible ground clearance can be about 0.05 inches and about 0.25 inches, and preferably about 0.125 inches.

Prior surface 152 maintenance machines typically have a vacuum passage on all sides of the sweep chamber 115 such as front, rear and sides. However, such sweeping system design may not be able to pick up large debris and may wind up "plowing" debris rather than draw them into the particulate collection system 140. Moreover, such large debris may damage the skirt on the front of the sweep chamber 115, thereby leading to dusting because of reduced vacuum being maintained. The skirting as described herein reduces such adverse problems by having the front of the sweep chamber 115 be exposed to particulate. Advantageously, the present disclosure provides a pair of counter-rotating brooms 110, 112 that eliminate the need for a front skirt, and instead, rely on cooperative air currents due to the opposed rotation of the brooms 110, 112 to draw and lift particulate into the hopper 144.

In operation, the surface maintenance machine 100 is operated on a surface 152 to sweep particulate therefrom. When the vacuum system 150 is engaged, dirt and debris are directed from the surface 152 into the chute 142 due to air currents generated by counter-rotation of the broom. The rotation of the front broom 110 may draw the particulate inward toward the machine 100, and the rotation of the front and/or the rear broom 112 may lift the particulate into the chute 142 positioned thereabove. Vacuumized airflow generated by the vacuum system 150 may further draw the particulate into the hopper 144. The skirt assembly 200 substantially isolates the sweep chamber 115 on the rear 210 and sides 212, 214.

Advantages of embodiments disclosed herein include elimination of front skirting. As a result, routing of airflow is improved. Improved routing of airflow also allows larger particulate than is conventional to be drawn and lifted, rather than plowed as was conventional with several known sweeping machines.

Thus, embodiments of the surface maintenance machine 100 with a skirt assembly 200 to allow particulate pick up are disclosed. The disclosed embodiments are presented for purposes of illustration and not limitation and other embodiments of the invention are possible. One skilled in the art will appreciate that various changes, adaptations, and modifications may be made without departing from the spirit of the invention.

The invention claimed is:

1. A surface maintenance machine comprising:

a body;

wheels for supporting the body for movement over a surface;

a pair of brooms housed in a sweep chamber configured to draw particulate on the surface to the front of the pair of brooms inwardly toward the surface maintenance machine;

a vacuum system configured to generate a vacuum for drawing particulate swept by the pair of brooms;

a chute defined by a front wrap and a rear wrap, the front wrap forming a front wrap pick-off point at one broom of the pair of brooms and the rear wrap forming a rear wrap pick-off point at the other broom of the pair of brooms, the chute positioned above the pair of brooms and in fluid communication with the vacuum system, the front wrap and the rear wrap forming a particulate passage having an inlet at the pair of brooms, the inlet extending from the front wrap pick-off point, across the pair of brooms, and to the rear pick-off point; and a skirt assembly generally surrounding the pair of brooms to form a vacuum passage to fluidly isolate the sweep chamber from an exterior of the surface maintenance machine, the skirt assembly comprising side skirts and a rear skirt, the rear skirt being positioned to the rear of the pair of brooms when the machine is moving in a generally forward direction, the skirt assembly not surrounding the pair of brooms on the front of the pair of brooms, the particulate on the surface to the front of the pair of brooms being drawn toward the surface maintenance machine and into the inlet of the particulate passage at a location between the pair of brooms due to air currents generated during the rotation of the pair of brooms.

2. The surface maintenance machine of claim 1, further comprising a vacuum passage formed by the skirt assembly fluidly isolating the vacuum system from the exterior of the machine.

3. The surface maintenance machine of claim 1, further comprising a hopper positioned generally to the front of and above the pair of brooms when the machine is moving in the generally forward direction, the rotation of the pair of brooms configured to pick off particulate from the surface and direct it toward the hopper.

4. The surface maintenance machine of claim 3, wherein in front wall of the hopper is in contact with the front wrap of the chute.

5. The surface maintenance machine of claim 1, wherein each broom of the pair of brooms is configured to rotate about an axis that extends parallel to the surface, and wherein each broom of the pair of brooms extends a distance between the side skirts.

6. The surface maintenance machine of claim 1, wherein the pair of brooms comprises a front broom and a rear broom, wherein the front broom is configured to rotate in a first direction that is configured to draw particulate on the surface from the front of the pair of brooms toward the rear broom, and wherein the rear broom is rotate in a second direction that is configured to lift particulate drawn by the front broom toward the chute, the second direction being opposite the first direction.

7. The surface maintenance machine of claim 6, wherein air current generated due to the rotation of the front broom is in a direction opposite to air currents generated due to the rotation of the rear broom.

8. The surface maintenance machine of claim 1, wherein the pair of brooms are movable between a transport position and an operating position, wherein, in the transport position, the pair of brooms are not in contact with the surface, and in the operating position, the pair of brooms are in contact with the surface.

9. The surface maintenance machine of claim 8, wherein, in the operating position, the front wrap of the chute is positioned further forward relative to its position in the transport position.

10. The surface maintenance machine of claim 1, wherein the pair of brooms have a gap therebetween.

11. The surface maintenance machine of claim 10, wherein the gap between the front and rear brooms is about 0.125 inches.

12. The surface maintenance machine of claim 1, wherein the surface maintenance machine is a dry sweeping machine.

* * * * *